US005820524A

United States Patent [19]

Chen

[11] Patent Number: 5,820,524

[45] Date of Patent: Oct. 13, 1998

[54] WALKING TYPE EXERCISER

[76] Inventor: Meng Tsung Chen, No. 31, 16 Lane, Bei-Chung Street, Tainan, Taiwan

[21] Appl. No.: 960,458

[22] Filed: Oct. 29, 1997

[51] Int. Cl.[6] ..... A63B 69/16; A63B 22/04

[52] U.S. Cl. ..... 482/51; 482/70; 482/57

[58] Field of Search ..... 482/51, 52, 53, 482/57, 70, 79, 80, 62

[56] References Cited

U.S. PATENT DOCUMENTS

| | | | |
|---|---|---|---|
| 5,518,473 | 5/1996 | Miller | 482/70 |
| 5,562,574 | 10/1996 | Miller | 482/52 |
| 5,653,662 | 8/1997 | Rodgers, Jr. | 482/51 |
| 5,683,333 | 11/1997 | Rodgers, Jr. | 482/57 |

FOREIGN PATENT DOCUMENTS

| | | | |
|---|---|---|---|
| 2919494 | 11/1980 | Germany | 482/51 |

*Primary Examiner*—Stephen R. Crow
*Attorney, Agent, or Firm*—Rosenberg, Klein & Bilker

[57] ABSTRACT

A walking type exerciser includes a main frame including two parallel horizontal beams, a flywheel rotatably mounted to the main frame, and two sliding members respectively, slidably mounted to the horizontal beams. Each sliding member includes a pedal pivotally attached thereto, and connecting rods are provided to interconnect the pedals with the flywheel.

2 Claims, 5 Drawing Sheets

WALKING TYPE EXERCISER

BACKGROUND OF THE INVENTION

The present invention relates to an ergonomic walking type exerciser.

Nowadays it is difficult to find a place to exercise in cities, and people often do not know which type of exercises are most suitable to him/her. Nevertheless, it is found that walking is the most common, natural exercise to human. The present invention is intended to provide a walking type exerciser which can be used indoors.

SUMMARY OF THE INVENTION

A walking type exerciser in accordance with the present invention comprises a main frame including two parallel horizontal beams, a flywheel rotatably mounted to the main frame, two sliding members respectively, slidably mounted to the horizontal beams, each sliding member including an arcuate member extending therefrom, two first connecting rods each having a first end connected to the axle of the flywheel to rotate therewith, two second connecting rods each having a first end pivotally connected to the second end of an associated first connecting rod and a second end pivotally connected to an associated sliding member, and two pedals each including an underside having a first end pivotally to a mediate section of an associated second connecting rod and a mediate section pivotally connected to an associated arcuate section. The exerciser may further comprise a handle attached to the main frame.

In use, the user may step on the pedals and exert forces on the pedals alternately, the flywheel is rotated via transmission of the connecting rods, the sliding members respectively reciprocate on the beams, while the pedals move in an ecliptic orbit.

Other objects, advantages, and novel features of the invention will become more apparent from the following detailed description when taken in conjunction with the accompanying drawings.

DESCRIPTION OF THE PREFERRED EMBODIMENT

Figure 1:
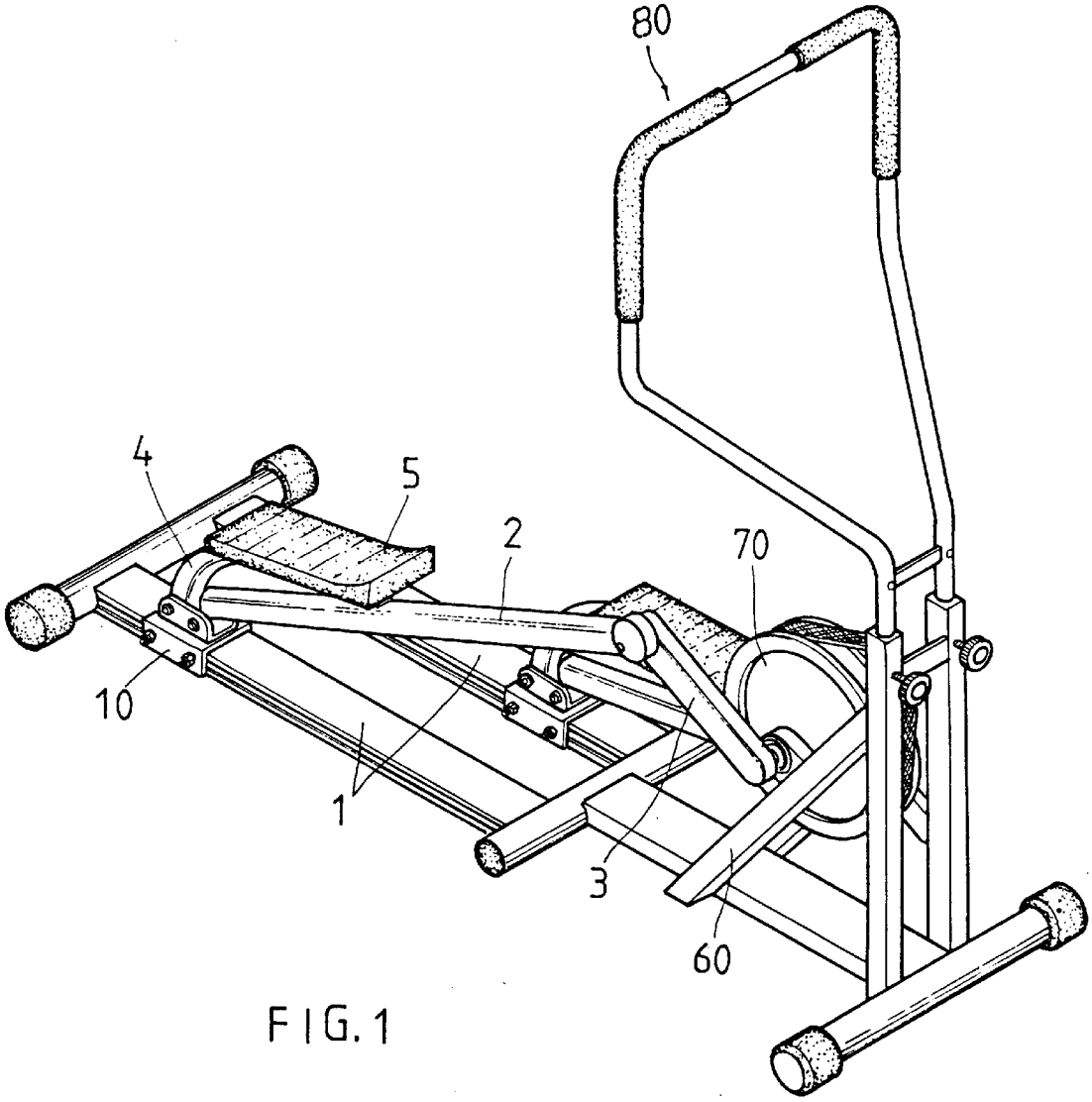
FIG. 1 is a perspective view of a walking type exerciser in accordance with the present invention.

Referring to the drawings and initially to FIG. 1, a walking type exerciser in accordance with the present invention generally includes a main frame including a pair of inclined beams 60 and two parallel horizontal beams 1, a handle 80 attached to the main frame for user's grasp, a flywheel 70 rotatably mounted between the inclined beams

Figure 2:
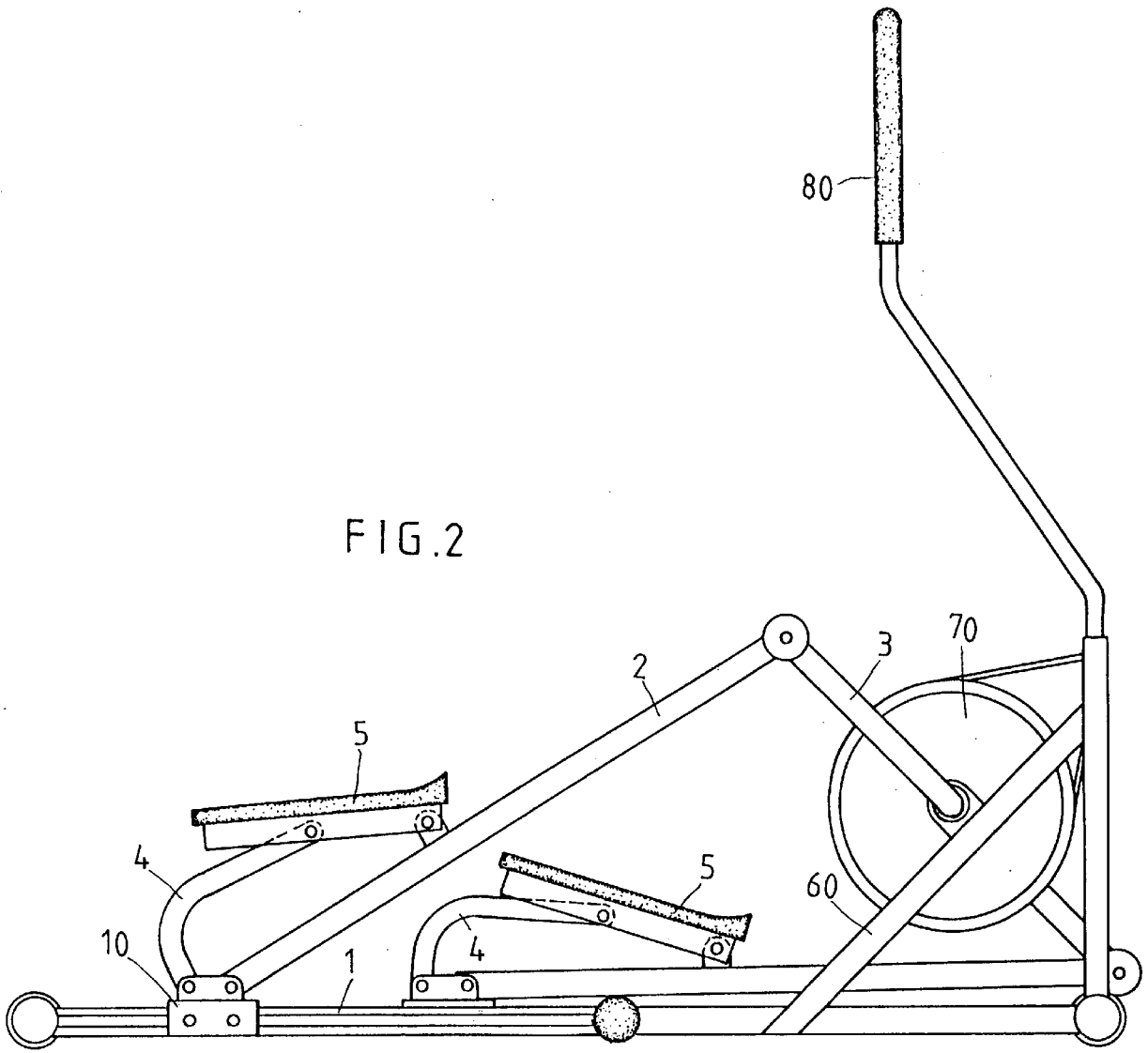
FIGS. 2 to 5 are schematic side elevational views illustrating operation of the walking type exerciser.
Figure 3:
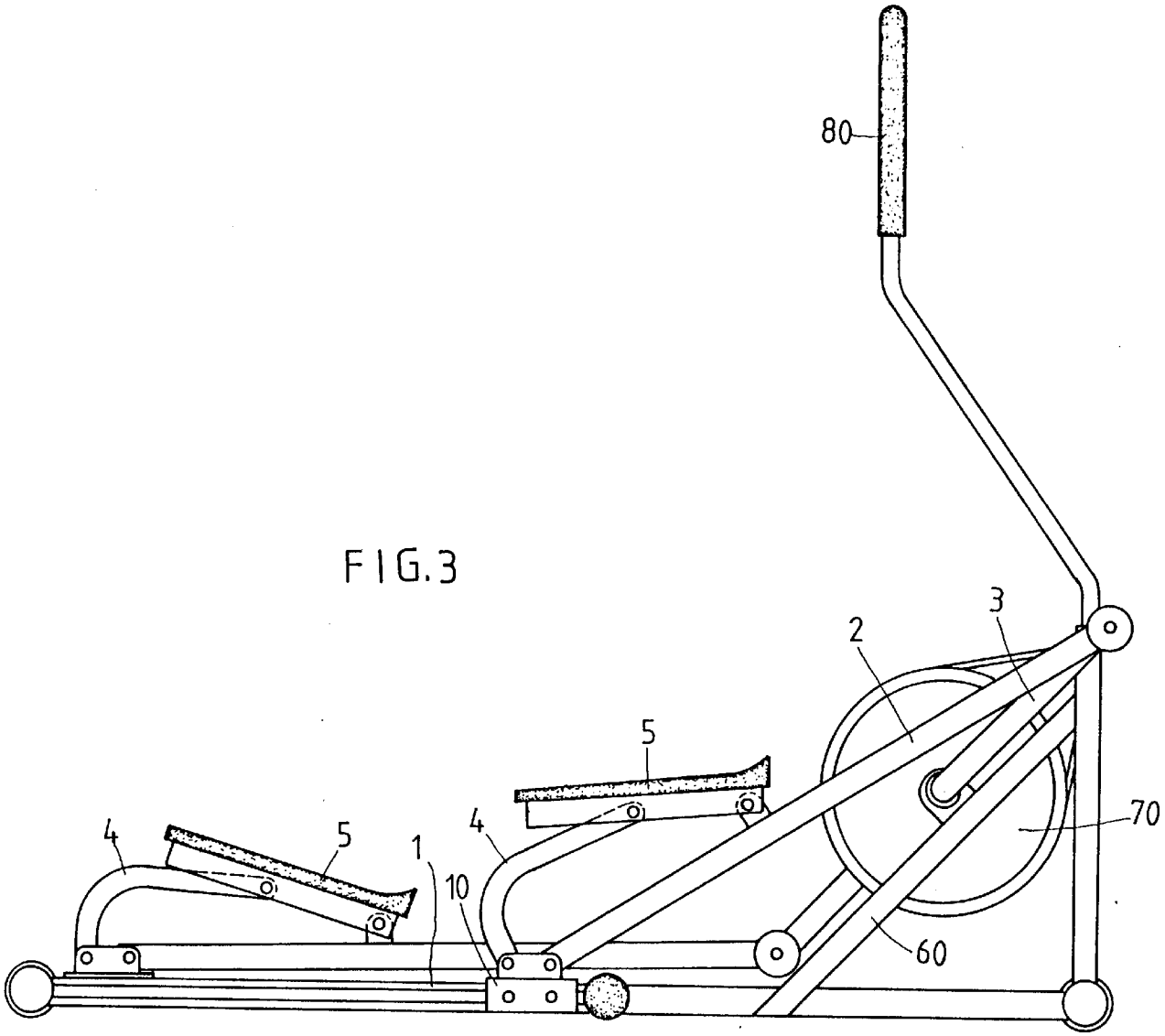
Figure 4:
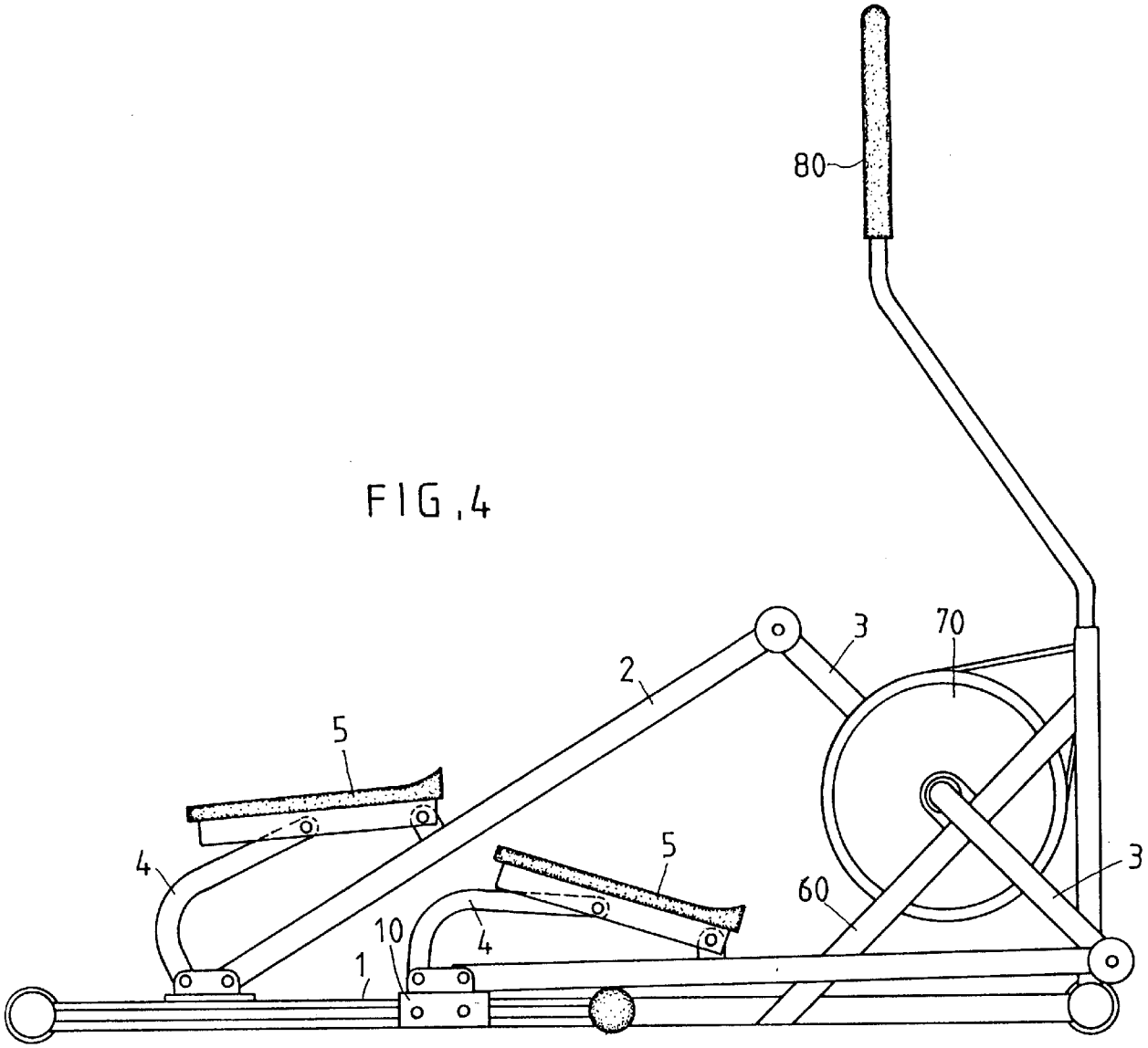
Figure 5:
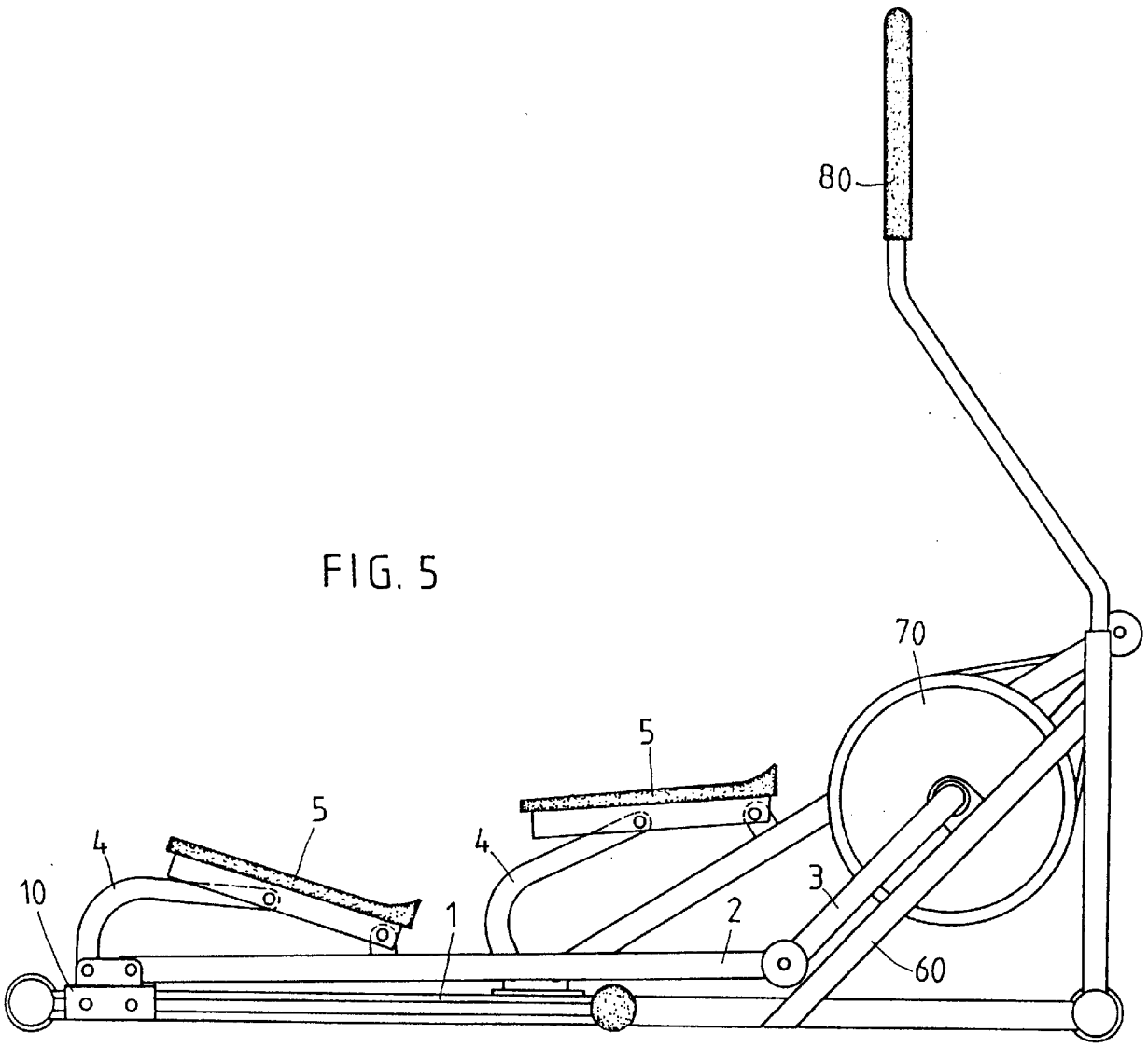

60, and two sliding members 10 respectively, slidably mounted to the horizontal beams 1. In addition, each sliding member 10 includes an arcuate member 4 (see FIG. 2) extending therefrom.

The exerciser further includes two first connecting rods 3 each of which has a first end connected to an end of an axle of the flywheel 70 to rotate therewith, and two second connecting rods 2 each has a first end pivotally connected to a second end of an associated first connecting rod 3 and a second end pivotally connected to an associated sliding member 10. Two pedals 5 are provided and each of which has an underside having a first end pivotally to a mediate section of an associated second connecting rod 2 and a mediate section pivotally connected to an associated arcuate section 4, best shown in FIG. 2.

In use, the user may step on the pedals 5 and exert forces on the pedals 5 alternately, the flywheel 70 is rotated via transmission of the connecting rods 2 and 3, the sliding members 10 respectively reciprocate on the beams 1, while the pedals 5 move in an ecliptic orbit. FIGS. 2 to 5 illustrate four positions of the movements. It is appreciated that inclination angles of the pedals 5 vary during the movements to provide an exercise similar to thereby provide an ergonomic design.

Although the invention has been explained in relation to its preferred embodiment, it is to be understood that many other possible modifications and variations can be made without departing from the spirit and scope of the invention as hereinafter claimed.

What is claimed is:

1. A walking type exerciser, comprising:

a main frame including two parallel horizontal beams, a flywheel rotatably mounted to the main frame and having an axle, two sliding members respectively, slidably mounted to the horizontal beams, each said sliding member including an arcuate member extending therefrom, two first connecting rods each having a first end connected to the axle of the flywheel to rotate therewith and a second end, two second connecting rods each having a first end pivotally connected to the second end of an associated said first connecting rod, a second end pivotally connected to an associated said sliding member, and a mediate section, and two pedals each including an underside having a first end pivotally connected to the mediate section of an associated said second connecting rod and a mediate section pivotally connected to an associated said arcuate section.

2. The walking type exerciser according to claim 1, further comprising a handle attached to the main frame.

* * * * *